US008167744B2

(12) United States Patent
Silvain et al.

(10) Patent No.: US 8,167,744 B2
(45) Date of Patent: May 1, 2012

(54) SWING ASSIST AND TRAINING DEVICE

(76) Inventors: Daniel Silvain, Tuscon, AZ (US); Christopher Silvain, Tucson, AZ (US)

( * ) Notice: Subject to any disclaimer, the term of this patent is extended or adjusted under 35 U.S.C. 154(b) by 0 days.

(21) Appl. No.: 12/753,875

(22) Filed: Apr. 3, 2010

(65) Prior Publication Data

US 2010/0267497 A1 Oct. 21, 2010

Related U.S. Application Data

(60) Provisional application No. 61/170,769, filed on Apr. 20, 2009.

(51) Int. Cl.
*A63B 59/06* (2006.01)
*A63B 69/00* (2006.01)

(52) U.S. Cl. ..... 473/457; 473/422; 473/568

(58) Field of Classification Search ..... 473/422, 473/450, 451, 457, 458, 464, 437, 523, 538, 473/549, 552, 568
See application file for complete search history.

(56) References Cited

U.S. PATENT DOCUMENTS

| | | | | | |
|---|---|---|---|---|---|
| 2,984,486 | A * | 5/1961 | Jones | 473/568 |
| 5,011,145 | A * | 4/1991 | Bartkowicz | 473/568 |
| 5,035,428 | A * | 7/1991 | Bartkowicz | 473/568 |
| 5,482,270 | A * | 1/1996 | Smith | 473/568 |
| 5,524,885 | A * | 6/1996 | Heo | 473/299 |
| 5,542,676 | A * | 8/1996 | Howe et al. | 473/202 |
| 5,577,722 | A * | 11/1996 | Glassberg | 473/457 |
| 5,611,533 | A * | 3/1997 | Williams | 473/568 |
| 5,839,983 | A * | 11/1998 | Kramer | 473/568 |
| 6,234,924 | B1 * | 5/2001 | Washburn, Jr. | 473/568 |
| 6,406,387 | B1 * | 6/2002 | Ryan | 473/457 |
| 6,949,036 | B2 * | 9/2005 | Ciesar et al. | 473/457 |
| 2002/0055402 | A1 * | 5/2002 | Ciesar et al. | 473/457 |
| 2003/0013563 | A1 * | 1/2003 | Ryan | 473/457 |
| 2003/0069095 | A1 * | 4/2003 | Turos | 473/457 |
| 2003/0144089 | A1 * | 7/2003 | Ryan | 473/457 |
| 2005/0202910 | A1 * | 9/2005 | Blount | 473/568 |
| 2008/0113832 | A1 * | 5/2008 | Ciesar et al. | 473/457 |
| 2009/0312125 | A1 * | 12/2009 | Kearns | 473/451 |

* cited by examiner

*Primary Examiner* — Mitra Aryanpour
(74) *Attorney, Agent, or Firm* — White-Welker & Welker, LLC; Matthew T. Welker, Esq.

(57) ABSTRACT

A rubber or synthetic texture sleeve that fits loosely over the existing grip. It is made from typical grip material for the application with the exception of having a smooth or textured interior and being oversized for the handle. The sleeve may be used with an interior liner between the handle and the grip for additional cushioning. The length of the sleeve will vary, but can be cut to fit the specific application. The sleeve fits loosely around the bat grip and does not replace or modify the existing grip or bat handle. The degree of twist is determined by the give in the material used allowing for a stronger grip because the friction normally generated from rotating hands around a stationary grip is reduced dramatically. The sleeve reduces vibration because of the increased padding and ability to have a stronger grip.

7 Claims, 5 Drawing Sheets

SWING ASSIST AND TRAINING DEVICE

CROSS REFERENCE TO RELATED APPLICATIONS

This application claims priority from U.S. Provisional Patent Application Ser. No. 61/170,769, entitled "Swing Assist and Training Device", filed on 20 Apr. 2009. The benefit under 35 USC §119(e) of the United States provisional application is hereby claimed, and the aforementioned application is hereby incorporated herein by reference.

FEDERALLY SPONSORED RESEARCH

Not Applicable

SEQUENCE LISTING OR PROGRAM

Not Applicable

TECHNICAL FIELD OF THE INVENTION

The present invention relates generally to a swing assist and training device. More specifically, the present invention relates to a swing assist and training device used on a baseball bat or any other sporting device that when two hands grip an apparatus that is to be swung.

BACKGROUND OF THE INVENTION

Typically, in baseball, when a hitter gets ready to swing the hands are not correctly aligned to deliver the maximum impact on the ball. This is because the ideal placement of the hands at impact point is when the middle knuckles of the hands align with each other. Before the batter swings the knuckles are rarely aligned because it is an unnatural way to align the hands before swinging.

By having the knuckles align to the optimal position during the swing greater accuracy can be achieved. What is needed is a sleeve that allows the batter to have optimal grip, while still being loose enough to allow the hands to rotate, reducing friction, hand abrasions, blisters, and providing for better accuracy.

Other prior art devices have attempted to solve this problem but have failed for numerous reasons. One competing grip is meant to be placed directly on the bat and under the standard grip or replacement grip as opposed to over any existing grip. This changes the nature of the bat and limits it only to players that desire a bat with the grip as the grip can not be moved out of the way for another batter.

Other prior art solutions teach grips that are pieced together by a notch system that attaches the around the handle as opposed to a single piece that can be pulled or rolled over the knob of the bat as taught by the present invention. Again, the failure in the prior art is to teach a grip that is not specified for a baseball bat only. Additionally, the grip must be fastened to the bat in some manner as opposed to having the option of being free moving or stationary. Such grips are intended to have a snug grip on the handle as opposed to an approximately ⅛th of an inch of free space between materials and is not allowed to completely twist freely.

Yet other prior art solutions teach a grip that is meant to be used with only one hand as opposed to both at the same time.

The rotating sleeve of the present invention does not alter the original bat or swinging implement, as all other devices known and taught in the prior art do to some degree. Additionally, the rotating sleeve of the present invention is useable for all hand types and sizes. Other systems taught and known in the prior art, such as the knuckle system, have notches that may not fit all hand types. The second under grip assumes that the hands are large enough to utilize the top part of the grip. Existing art is not flexible enough to accommodate all hand sizes especially small hands, such as children.

What is needed is a grip or sleeve that is removable and easily fits over the handle of a baseball bat that allows the hands and wrists to rotate freely and reduces surface friction, which in turn decreases the likelihood of the user developing blisters.

SUMMARY OF THE INVENTION

The present invention is a rubber or synthetic texture sleeve that fits loosely over the existing grip. It is made from typical grip material for the application with the exception of having a smooth or textured interior and being oversized for the handle. The invention may be used with an interior liner between the handle and the grip for additional cushioning. The length of the sleeve will vary, but can be cut to fit the specific application.

The present invention fits loosely around the bat grip and does not replace or modify the existing grip or bat handle. The degree of twist is determined by the give in the material used allowing for a stronger grip because the friction normally generated from rotating hands around a stationary grip is reduced dramatically. The present invention reduces vibration because of the increased padding and ability to have a stronger grip.

BRIEF DESCRIPTION OF THE DRAWINGS

The accompanying drawings, which are incorporated herein an form a part of the specification, illustrate the present invention and, together with the description, further serve to explain the principles of the invention and to enable a person skilled in the pertinent art to make and use the invention.

DETAILED DESCRIPTION OF THE INVENTION

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention.

However, it is understood that the invention may be practiced without these specific details. In other instances, well-known structures and techniques known to one of ordinary skill in the art have not been shown in detail in order not to obscure the invention. Referring to the figures, it is possible to see the various major elements constituting the apparatus of the present invention.

Figure 1:
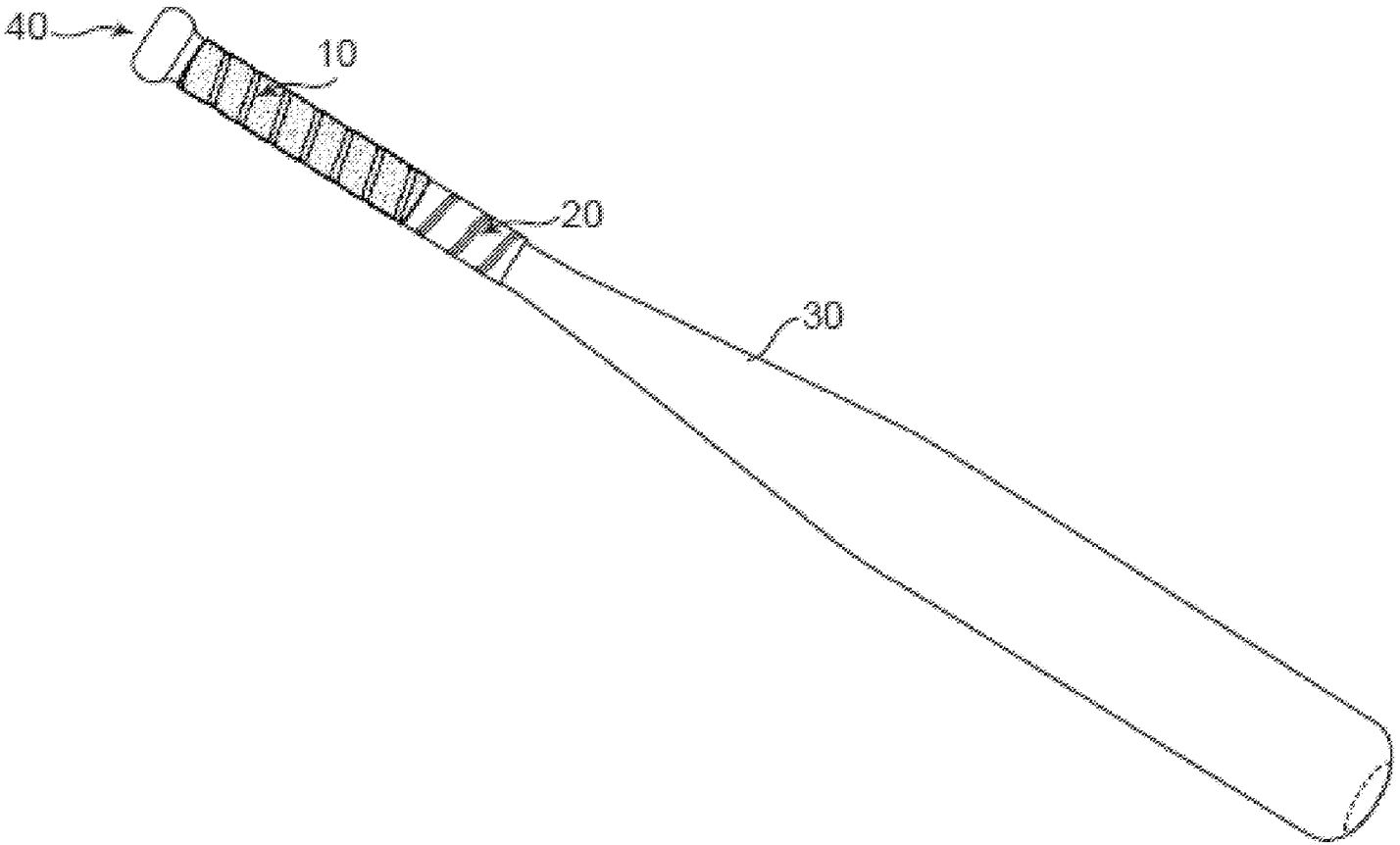
FIG. 1 is a illustration of the sleeve of the present invention installed on a baseball bat.
Figure 2:
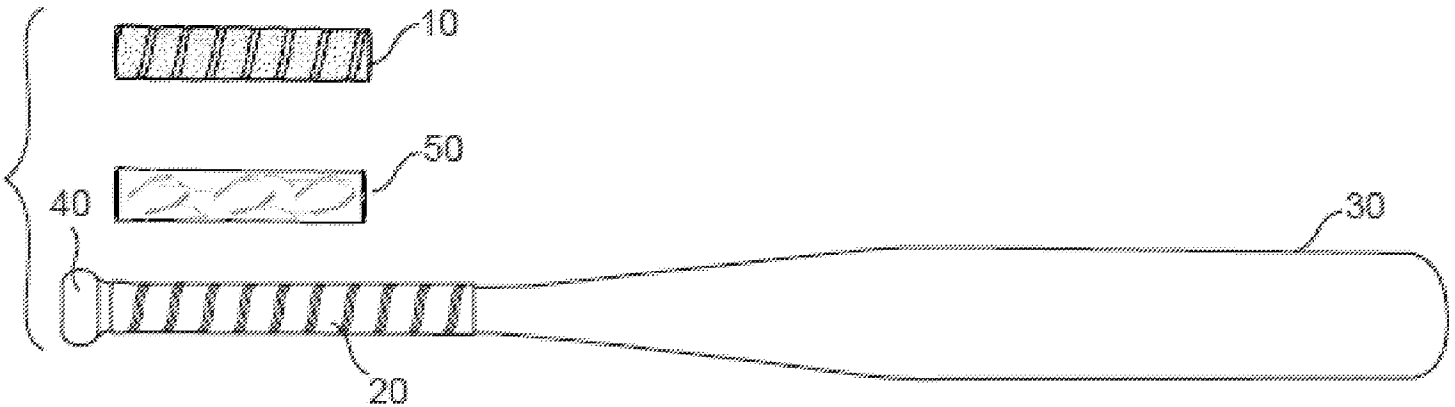
FIG. 2 is an illustration of the sleeve and optional interior liner between the handle and the grip for additional cushioning that may be used in one embodiment of the device.
Figure 3:
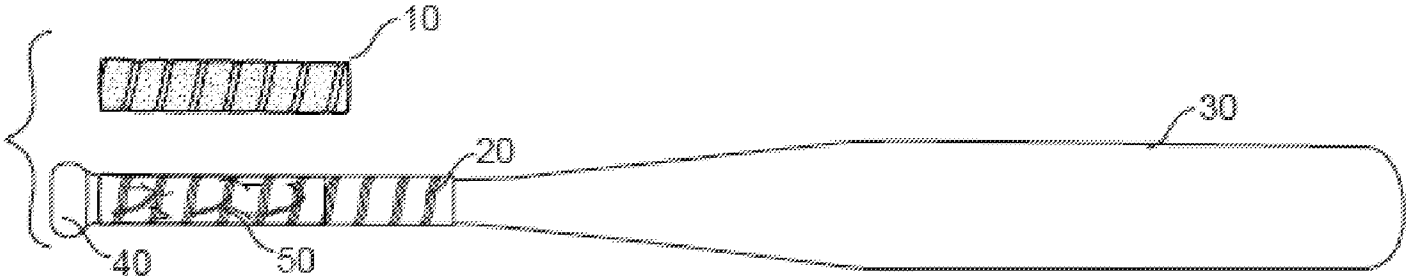
FIG. 3 illustrates the liner installed on the bat handle.

Now referring to FIG. 1, the present invention is a rotating sleeve 10 that goes over a sport grip 20 such as that on a baseball or softball bat 30, but is also relative to golf clubs, hockey sticks, cricket bats and handles where two hands grip the handle of a swinging implement. The rotating sleeve 10 allows a hitter's hands to rotate around a baseball or softball bat 30 or similar sports device without loosening their grip on the baseball or softball bat's existing sports grip 20 located on the handle baseball or softball bat 30 or rotating the baseball or softball bat 30.

Typically when a hitter gets ready to swing the hands are not correctly aligned to deliver the maximum impact on the ball. This is because the ideal placement of the hands at impact point is when the middle knuckles of the hands align with each other. Before the batter swings the knuckles are rarely aligned because it is an unnatural way to align the hands before swinging.

By having the knuckles align to the optimal position during the swing greater accuracy can be achieved. A hitter can grip the existing sport grip 20 located on the handle of a baseball or softball bat 30 tighter than without the rotating sleeve 10, without the rotating sleeve 10 the hitter's grip must loosen on the existing sport grip 20 located on the handle of the baseball or softball bat 30 to allow the hands to rotate. This rotation causes friction. The present invention reduces friction and thus reduces hand abrasions and blisters.

With the reduction in friction the batter can achieve greater baseball or softball bat 30 speed with increased accuracy. It will also reduce the tendency to let go of the baseball or softball bat 30 during the swing, increasing safety of those within throwing distance of the baseball or softball bat 30.

With the rotating sleeve 10 rotating around the existing grip 20 on the handle of the baseball or softball bat 30, the baseball or softball bat 30 will not rotate during the swing giving the batter greater control of the baseball or softball bat 30. Without the rotating sleeve 10 the baseball or softball bat 30 is likely to rotate significantly during the swing to bring the knuckles into alignment. Failure to align the knuckles at impact reduces accuracy, speed, and hitting the ball outside the impact zone. The rotating sleeve 10 can also be rolled up for hitters that do not wish to use the rotating sleeve 10.

Figure 4:
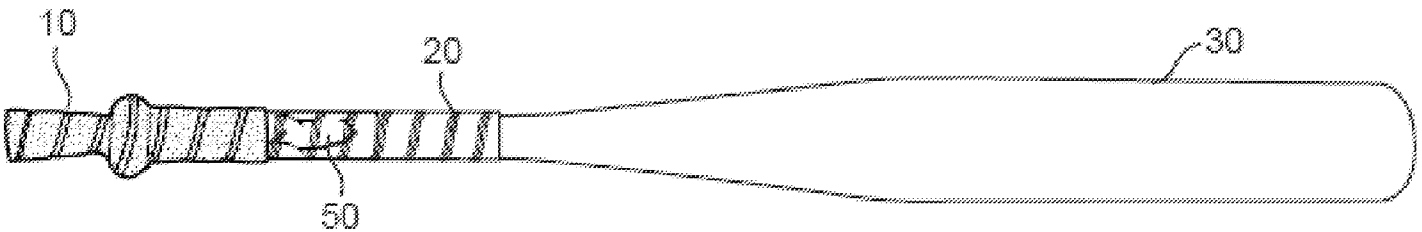
FIGS. 4 and 5 illustrate the sleeve being installed or rolled over the end of a baseball bat onto the liner covering the original bat grip.
Figure 5:
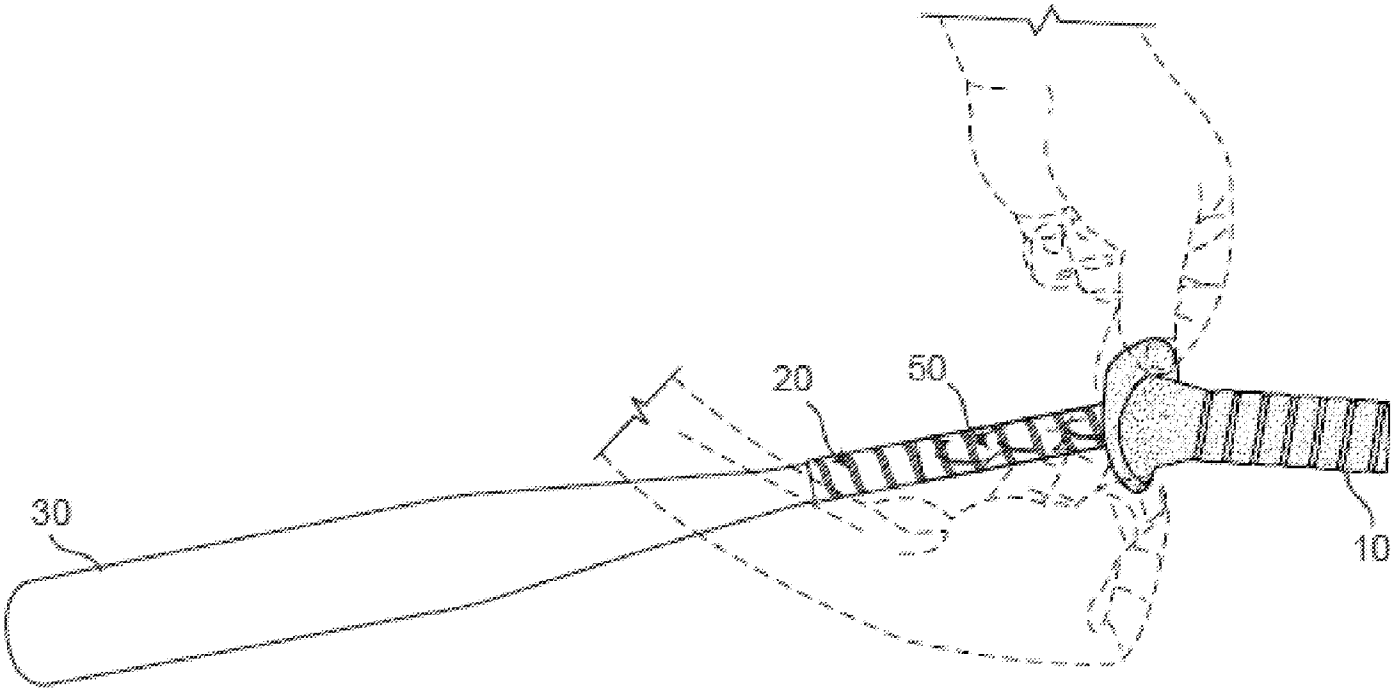
Figure 6:
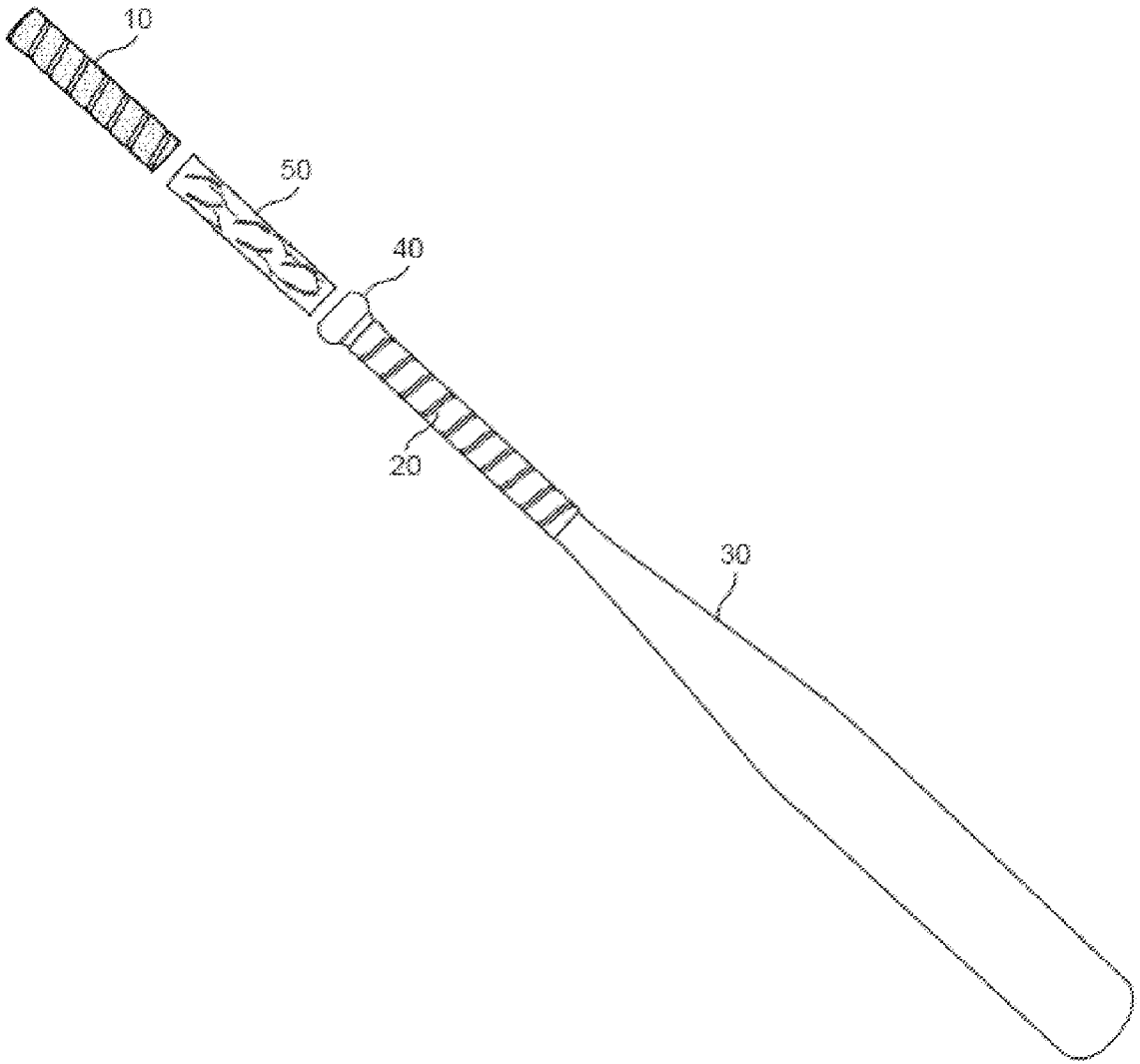
FIG. 6 is an exploded view of the present invention.

The present invention is a rubber or synthetic texture rotating sleeve 10 that fits loosely over the existing bat sport grip 20 located on the handle of a swinging implement such as a baseball or softball bat 30, as shown in FIGS. 4 and 5. The rotating sleeve 10 is made from typical grip material for the application with the exception of having a smooth or textured interior and being oversized for the handle of the baseball or softball bat 30. In one embodiment, the rotating sleeve may be comprised of an outermost elastomeric layer having a pliable outer surface that facilitates a user gripping the rotating sleeve during use of the swinging implement.

The invention may be used with an interior liner 50 between the handle and the rotating sleeve 10 for additional cushioning as shown in FIGS. 2-6. The length of the rotating sleeve 10 will vary, but can be cut to fit the specific application. The rotating sleeve 10 may or not be used with the interior liner 50. If interior liner 50 is used, the interior liner 50 can be a one piece wrap around similar to a standard baseball grip, or a tape that can be wrapped around an existing grip 20 or the handle of a baseball or softball bat 30 or other swinging implement. The interior liner 50 is also comprised of a high slip low friction surface material to allow the rotating sleeve 10 to rotate around an existing grip 20 or the handle of a baseball or softball bat 30 or other swinging implement.

In an alternative embodiment, without the interior liner 50 the inner surface of the rotating sleeve 10 would be made from a low friction, high slip material and have slip properties allowing the rotating sleeve 10 to rotate freely around the handle or existing grip 20 of the swinging implement.

In other alternative embodiments of the invention, the rotating sleeve 10 may be used with or without the interior liner 50 for any use of work where the hands rotate, such as jackhammers, sledgehammers, and other similar construction equipment.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. A swing training device comprising:

a rotating sleeve slidably received on a handle of a swinging implement; the rotating sleeve is comprised of an exterior surface made from typical grip material; and an interior, high slip surface fits loosely over the handle of the swinging implement;

the rotating sleeve is oversized for the handle allowing the rotating sleeve to rotate freely around the handle of the swinging implement;

an interior liner loosely positioned between the handle of the swinging implement and the rotating sleeve;

the rotating sleeve fits loosely over and contacts the interior liner, wherein the interior liner is positioned over an existing grip of the handle of the swinging implement.

2. The swing training device of claim 1, wherein the typical grip material for the rotating sleeve has an exterior surface formed of one of rubber or synthetic textured material and an interior surface formed of a smooth or textured interior.

3. The swing training device of claim 1, wherein the typical grip material for the rotating sleeve is for a baseball or softball.

4. The swing training device of claim 1, wherein the typical grip material for the rotating sleeve is comprised of an outermost elastomeric layer having a pliable outer surface that facilitates a user gripping the sleeve during use of the swinging implement.

5. The swing training device of claim 4, wherein the typical grip material for the rotating sleeve is comprised of an inner most layer having a high slip outer surface that facilitates the rotating sleeve rotating freely around the handle of the swinging implement during use.

6. The swing training device of claim 1, wherein;

the typical grip material for the rotating sleeve is comprised of an exterior surface made from rubber or other synthetic texture; and the rotating sleeve is oversized allowing the rotating sleeve to rotate freely around the existing grip of the swinging implement.

7. The swing training device of claim 1, wherein the typical grip material for the rotating sleeve has an exterior surface formed of one of rubber or synthetic textured material and an interior surface formed of a smooth inner with a high slip surface.

* * * * *